US006327710B1

(12) United States Patent
Dunn et al.

(10) Patent No.: US 6,327,710 B1
(45) Date of Patent: Dec. 11, 2001

(54) DEFLECTING AND PROTECTING SHIELD GUARD DEVICE

(76) Inventors: Earl E. Dunn; Adam A. Dunn, both of 808 Wooddale Church Rd., Knoxville, TN (US) 37924; Tim A. Manis, 2908 Sinking Springs La., Knoxville, TN (US) 37914

( * ) Notice: Subject to any disclaimer, the term of this patent is extended or adjusted under 35 U.S.C. 154(b) by 0 days.

(21) Appl. No.: 09/444,089

(22) Filed: Nov. 22, 1999

(51) Int. Cl.[7] ..... A41D 13/00
(52) U.S. Cl. ..... 2/22
(58) Field of Search ..... 2/22, 23, 24, 455, 2/16; 602/62, 23, 26, 27

(56) References Cited

U.S. PATENT DOCUMENTS

| | | | | |
|---|---|---|---|---|
| 4,888,826 | * | 12/1989 | Parsons, Jr. et al. | 2/22 |
| 5,634,211 | * | 6/1997 | Chen | 2/22 |
| 5,829,055 | * | 11/1998 | Collins et al. | 2/22 |
| 5,943,695 | * | 8/1999 | Yen | 2/22 |
| 6,065,152 | * | 5/2000 | Parker | 2/22 |

* cited by examiner

*Primary Examiner*—Michael A. Neas

(74) *Attorney, Agent, or Firm*—M. Alex Brown, Patent Attorney

(57) ABSTRACT

A deflecting and protective shield guard device, system and method of manufacturing and use is disclosed for utilization on or interaction with the lower or distal and proximately middle areas of a user's limb, when a user is exposed to a work environment where equipment is being used, or where ground or airborne particles, substances or debris are being emitted. The device has a shield body having connecting pairs of positionally opposing, end sections and lateral portions; and outboard and inboard surfaces. One end section is arced in shape, the other is sinusoidal, or in the nature of a periodic function curve having maximum peak and minimum sulcate portions; and each of the lateral portions is provided with configurations which exhibit wave-curve segment, arced, and linear, areas. Each of the configurational areas of the shield, in preferred embodiments, can be conceptually described and positionally oriented in terms of known mathematical and geometric terms, Cartesian coordinate axis, or t-axis-lines or tangent-lines; and positional angles and arced portions related thereto. The invention is fabricated in embodiments of transparent and flexible polymer material with preferred thicknesses, for ease of monitoring the position of the installed shield in relation to underlying apparel and anatomy; and can also be fabricated in many design colors. Positionable coupling systems, trim portions, and positioning grooves; for ease of fitting and transport; are provided.

26 Claims, 8 Drawing Sheets

DEFLECTING AND PROTECTING SHIELD GUARD DEVICE

FIELD OF THE INVENTION

The present invention relates to a protective guard device for use in relation to mid and lower leg areas for protection to such areas when a worker is exposed to particles or pieces dislodged or emanating from a work area.

BACKGROUND INFORMATION

Although no references were found specifically relating to the present invention, structurally and functionally, in Applicants' opinion, those references typical of, otherwise, marginally or somewhat similar, related prior art, found in the process of a patent search in this crowded technology; include United States Patents to: Buchanan, U.S. Pat. No. 5,784,715; Bell, U.S. Pat. No. 5,613,250; Miller, U.S. Pat. No. 5,570,470; Carter, U.S. Pat. No. 5,031,247; Hightower, Jr., Re. U.S. Pat. No. 32,506; Winer, U.S. Pat. No. 4,665,662; Cho, U.S. Pat. No. 4,497,070; Peachey, Des. U.S. Pat. No. 393,502; Hargrove, Des. U.S. Pat. No. 365,667; Pettinelli, Des. U.S. Pat. No. 306,921; Fugere et al., U.S. Pat. No. 4,001,953; Hightower, Jr., et al., U.S. Pat. No. 5,170,503; Collins et al., U.S. Pat. No. 5,829,055; Parker, U.S. Pat. No. 3,269,036; Martin, U.S. Pat. No. 3,191,185; Brewer, U.S. Pat. No. 3,153,864; Pence, U.S. Pat. No. 2,945,308; Twiss, U.S. Pat. No. 2,779,108; Martin, U.S. Pat. No. 1,708,144; Völker et al., U.S. Pat. No. 5,477,558; Bellasalma, U.S. Pat. No. 4,036,220; Parker, Des. U.S. Pat. No. 354,615; and Van Doren, Des. U.S. Pat. No. 251,937.

Specifically, Buchanan '715 teaches a ladder-mate shin protector having three (3) protective joined layers, for minimizing the possibility that a user will slip if this apparatus strikes against a step or other 'ladder' part. Buchanan is distinguishable from the present invention configurationally, structurally and functionally.

Bell '250 teaches a leg, ankle and foot apparel protector, having a leg cover piece, a shoe cover piece and a foot sole piece, for providing leg, ankle and foot apparel protection to the wearer's apparel, from flying debris thrown off by motorized string trimmers, lawn mowers, tillers and garden equipment. It is distinguishable configurationally and structurally from the present invention.

Miller '470 teaches a leg protection device having a rectangular configuration and a plurality of overlapping layers, different from the invention herein.

Carter '247 teaches a leg protector of rectangular configuration, and structurally designed to wrap completely around the leg area of a user; and, likewise, distinguishable from the present invention.

Winer '562 teaches a leg protecting apparatus, having a 'calf' cover portion and a cover supporting portion. The calf portion has a main section having a rectangular configuration with differentially shorter upper and lower edges and longer side edges; for protecting the leg of a bicycle rider. It differs configurationally, structurally and functionally from the invention herein.

Cho '070 teaches a unitary leg and foot protective device, fabricated of soft energy absorbing material; and having a 'lower' portion for covering the top and sides of the 'foot' of the wearer, a 'middle' portion for covering the front and sides of the wearer's ankle, and an 'upper' portion for covering the shin of the wearer. Functionally, Cho is designed for use in participation in the 'martial arts.' It, too, is substantially distinguishable configurationally, structurally and functionally.

Peachey '502, Hargrove '667, Van Doren '937 and Pettinelli '921 teach ornamental designs of leg protectors or combined ankle and/or shin protectors. Each is substantially distinguishable on the basis of configurational design and pattern and exhibited structure.

Brewer '864 teaches a protective guard vastly different in the number and types of structural components, configurational shapes and installment positioning and modes.

Hightower '506 and '503, Parker '036, Martin '185, Pence '308 and Twiss '108 each teach respective snake or wildlife protective gear which is substantially different from the present invention in functional application, number and type of structural elements and installation fitting. In this regard a snake gaiter covering was also apparently available on the U.S. market some 20 to 25 years ago which provided portions of its shape in a curved or partly s-like form, was constructed of a thick, opaque and leather-like material; and had a zipper for closure. This covering was structurally and functionally distinguishable from the present invention. No patent reference or publication is known to exist regarding this snake covering.

Bellasalma '220, Völker '558, Collins '055 and Fugere '953 teach athletic protective equipment vastly distinguishable from the present invention in functional application, pattern and structural configuration, and number and types of structural elements.

Parker '615 teaches an ornamental design for half chap leg covering; and Martin '144 teaches a stocking protector. Each is designed to be worn as a part of other clothing in everyday public and social settings; and is substantially distinguishable from the present invention in functional use, and configuration and types of structural components.

None of the references located in the prior art specifically illustrate or disclose the deflecting and Protecting Device of the present invention. Nor is the present invention obvious in view of any of the prior art references listed or found in this crowded technology. In addition, all of the prior art heretofore known suffer from a number of structural and functional disadvantages, and problems in construction and use.

None of the prior art devices disclose or adequately address the problems of material flexibility and resilience, installment positioning, and user comfort and ease of movement when a protective device is installed for use in relation to gardening, agriculture, construction, or other work exposing the user to flying, emitting, emanating or issuing debris, particles or other matter from such a work site.

Additionally, none of the prior art devices disclose the advantage of both effective configuration and simplicity of construction for protecting the lower ankle, areas above the knee, and areas on the leg therebetween; while also providing the ease of transparent visual monitoring of the specific areas being covered and shielded by a protective guard, for more effective fitting, protection and the wearer's movement flexibility; and for desired adjustment after the device is installed for work use.

Also, other devices do not afford the user the ability to comfortably wear the device both with and without other clothing, apparel or equipment; nor do they afford adequate knee protection while allowing adequate movement and flexibility of the user's knee.

Further, the prior art devices do not provide a user-friendly, built-in, handle and fitting means for conveniently installing and positioning the device in relation to a wearer; and for easily moving or transporting the device when it is not being worn.

Additionally, the prior art devices do not provide the above listed characteristics, while also providing ease of installation and disengagement, one convenient size, in preferred embodiments, to fit all users, a multiplicity of see-through transparent portions and/or trim, colorations, designs or patterns; the contemporaneous ability to protect the user against splattering, stain-producing substances; clear areas, upon installment, for upper and lower air ventilation in relation to the user's leg; utilization of marine vinyl and/or various vinyl plastic or other polymer material in trim, liner, or shield support areas; and use of various preselected thicknesses of a shield body to provide stain and object protection while also providing flexibility of movement to the user.

These and other disadvantages, structurally and functionally, of the prior art, will become apparent in reviewing the remainder of the present specification, claims and drawings.

Accordingly, it is an object of the present invention to provide a user-friendly, flexible, resilient, transportable and easily positionably fitting, stain and object protective and deflecting guard device for use in work areas on one or both of the user's middle and lower leg areas for stain and impact protection thereof.

It is a further object of the invention to provide a flexible shielding, protective device having a substantially improved shape and configuration, material construction and thickness; and ease of installation and securement so that the users leg portions and joints are more flexible and adoptive (when wearing the present device) to changing work conditions, while protecting such areas from stain splattering material and flying or emitting debris or particle substances. A related object, in preferred embodiments of the invention, is to also provide a device a device substantially fabricated from a transparent material.

It is also an object of the present invention, in preferred embodiments, to provide a deflecting and protecting device which has a substantially improved configurational utility; and which is expecially useful, when installed on one or either mid-lower leg, for protection against rock, particle, vegetative/herbivorous material, or other ground or airborne material, the result of using grass or weed cutting, gardening, agricultural or landscaping equipment at a work site.

It is yet a further object of the invention to provide a flexibly fitting and positionable, protective shielding guard, in preferred embodiments thereof, which has its own built-in means or system for handling, transporting and positioning the present device; and, in preferred embodiments, for see-through monitoring of the exact position of the fitted/installed invention in relation to underlying apparel and/or to knee (or stifle), lower leg, or joint location, when the invention is installed on either leg.

It will, therefore, be understood that substantial and distinguishable structural and functional advantages are realized in the present invention over the prior art devices; and that the present invention's novel structure, diverse utility, broad functional applications serve as important bases of novelty and distinction, over the prior art, in this regard.

SUMMARY OF THE INVENTION

The foregoing and other objects of the invention can be achieved with the present invention, system, device, assembly and functional method of construction and use; which is a deflecting and protective guard, of flexible and resilient construction for use in interaction with either leg of a user, at middle, lower and adjacent portions thereof, in work areas where ground and airborne particles and substances are emitted in relation to work equipment to which a user is proximate and positionally oriented. The deflecting and protective guard of the present invention is provided with a shield body member, having inboard and outboard surfaces and a widthwise perimeter side extending thereabout. The widthwise perimeter side comprises first and second end sections and first and second lateral portions. Each of the first and second end sections have first and second end portions and a midpoint portion therebetween.

Each of the midpoint portions of the respective first and second end sections define, therebetween, an imaginary axis line which substantially bifurcates each of the inboard and outboard surfaces, when viewed from above and below, thereby defining a first bifurcated portion and a second bifurcated portion.

Each of the first and second lateral portions have first and second subportion segments. The first subportion segment of the first lateral portion has first and second ends and is substantially in the configuration of a sinusoidal wave between said first and second ends, when viewed from above and below, the first end, thereof, being attached to the second end portion of the first end section. The second subportion segment of the first lateral portion has first and second rounded end portions, and a linear configurational portion therebetween, when viewed from above and below, the first rounded end portion, thereof, being attached to the second end of the first subportion segment of the first lateral portion, and the second rounded end portion, thereof, being attached to the second end portion of the second end section.

The second subportion segment of the second lateral portion had first and second rounded end portions, and a linear configurational portion therebetween, when viewed from above and below, the second rounded end portion, thereof, being attached to the first end portion of the second end section.

The first subportion segment of the second lateral portion has first and second ends, and is substantially in the configuration of a sinusoidal wave, between said first and second ends, when viewed from above and below, the second end, thereof, being attached to the first rounded portion of the second subportion segment of said second lateral portion, and the first end, thereof, being attached to the first end portion of said first end section.

The deflecting and protective guard further comprises means for transporting and installably positioning the shield body member, being defined by the inboard and outboard surfaces, thereof, and extending therethrough; and means for coupling the first lateral portion of the widthwise perimeter side to the second lateral portion of the widthwise perimeter side.

Therefore, the deflecting and protective guard is installable in interaction with a leg of a user, and fitably positionable to shield and protect the lower areas and joints of a user's leg and the middle leg portions of a user's leg at and above the knee and stifle of such a leg of a user.

BRIEF DESCRIPTION OF THE DRAWINGS

FIG. 2 illustrates, by general schematic representation, areas of a user's leg, foot and knee (or stifle area); and FIG. 3 illustrates by general diagrammatic representation, and broken-lines, areas of a user's leg, knee and foot, and, by general diagrammatic representations, a work environment area and a weed-cutting, gardening device. In FIGS. 2 and 3, such representations are for illustrative and exemplar purposes only and do not form, represent or constitute part of the present invention.

Reference Numbers in Drawings

Figure 1:
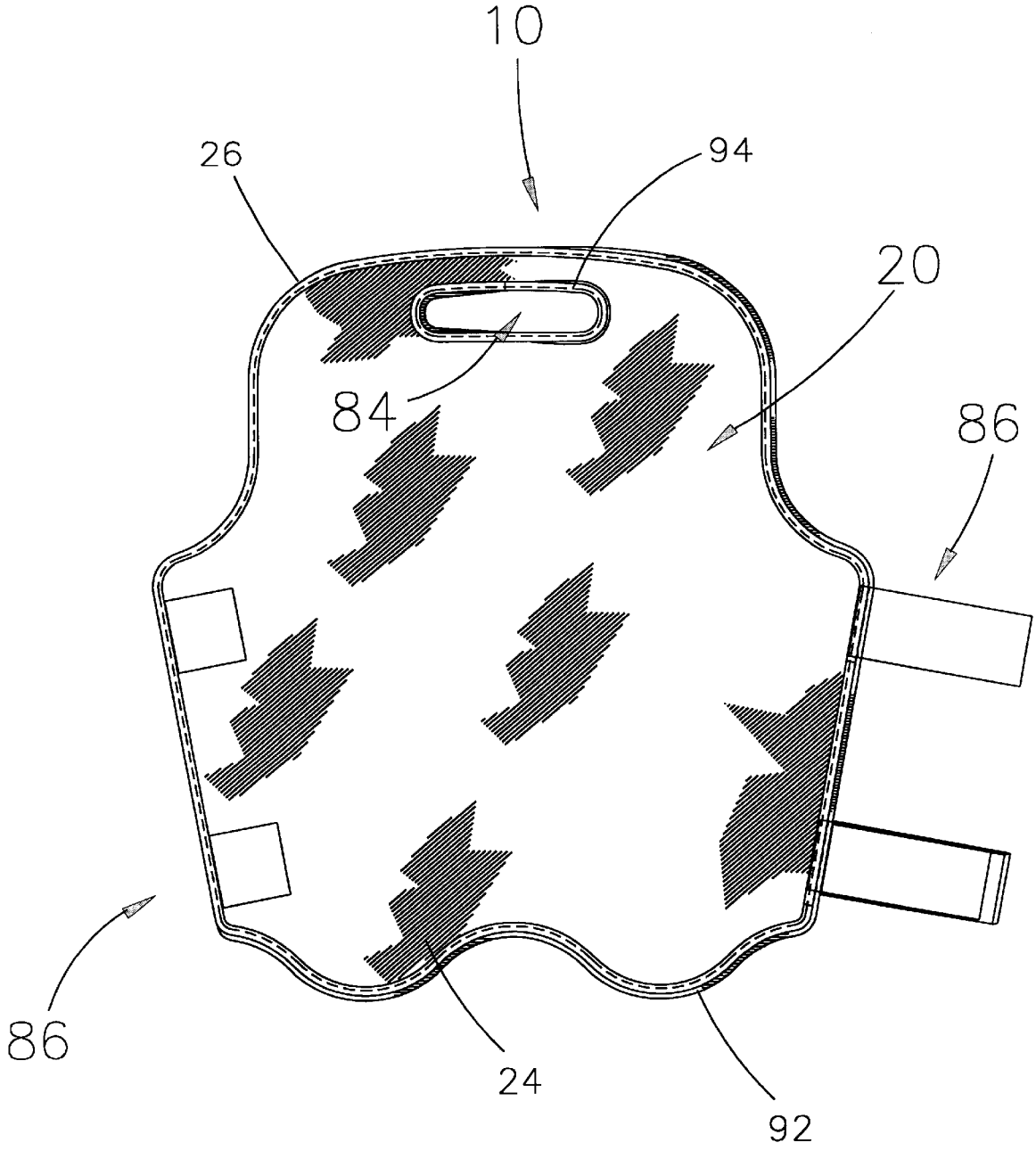
FIG. 1 is an elevated view, from above the front or outboard surface, of one preferred embodiment of the novel deflecting and protecting device of the present invention.

10 Deflecting and Protecting Shield Guard Device (Shield Guard)
12 leg of a user
14 foot of a user
16 knee (or stifle area) of a user
18 work area (environment)
19 work equipment
20 shield body member
22 inboard surface of (20)
24 outboard surface of (20)
26 widthwise perimeter side of (20)
28 first end section of (26)
30 second end section of (26)
32 first lateral portion of (26)
34 second lateral portion of (26)
36 first end portion of (28)
38 second end portion of (28)
40 midpoint portion of (28)
42 first end portion of (30)
44 second end portion of (30)
46 midpoint portion of (30)
47 imaginary axis line of (40) and (46)
48 first bifurcated portion
50 second bifurcated portion
52 first subportion segment of (32)
54 further subportion segment of (32)
56 first end of (52)
58 second end of (52)
60 sinusoidal wave portion of (52)
62 first rounded end portion of (54)
64 further rounded end portion of (54)
66 linear configurational portion of (54)
68 sinusoidal wave of (30)
70 first subportion segment of (34)
72 further subportion segment of (34)
73 linear configurational portion of (72)
74 first rounded end portion of (72)
76 further rounded end portion of (72)
78 first end of (70)
80 second end of (70)
82 sinusoidal wave portion of (70)
84 hand positioning hole
86 coupling system
88 hook band of (86)
90 loop band of (86)
92 first trim support segment
94 further trim support segment
96 arced convex-like perimeter of (28)
98 concave visual element of (28)
100 first peak configurational subportion of (30)
102 further peak configurational subportion of (30)
104 sulcate configurational subportion of (30)
106 peak configurational element of (52)
108 depressed sulcate configurational element of (52)
110 peak configurational element of (82)
112 depressed sulcate configurational element of (82)
114 first subportion of (32) (Another embodiment)
116 second subportion of (32) (Another embodiment)
118 third subportion of (32) (Another embodiment)
120 first subportion of (34) (Another embodiment)
122 second subportion of (34) (Another embodiment)
124 third subportion of (34) (Another embodiment)
28–116 t-line axis
28–122 t-line axis
$\alpha_1$ angle alpha in relation to (118) and (28-116)
66L positional space or axial line of (66)
73L positional space or axial line of (73)
28T tangent line in relation to (28)
30P tangent line in relation to peak curve areas of (30)
30S tangent line in relation to sulcate-valley curve areas of (30)
$\alpha_2$ angle alpha in relation to (124) and (28-122)

DETAILED DESCRIPTION OF THE PREFERRED EMBODIMENTS OF THE INVENTION

The following description of the preferred embodiments of the concepts and teaching of the present invention is made in reference to the accompanying drawing figures which constitute preselected illustrated examples of the structural and functional elements of the invention, among many other examples existing within the scope and spirit of the present invention.

Referring now to the drawings, FIGS. 1 through 9A, thereof, there is shown a deflecting and protecting shield guard device 10, of the present invention, referred to herein as the "Shield Guard 10."

The Shield Guard 10 is fabricated of flexible and resilient construction for use in interaction with a leg 12 or limb of a human user, preferably in fitted, installed position to protect lower areas of the leg, on the ankle, just above the foot 14, up to and including middle areas of the leg, including the knee 16 or stifle areas, and adjacent areas above the knee 16 on the leg 12 (shown by example).

The present invention is designed to be utilized in a diverse number of work areas 18; such as garden, forestry and agricultural work sites, home improvement sites, construction sites, and a number of other work areas where ground and/or airborne particles, substances, debris and other matter are emitted in relation to a work environment and/or work equipment 19; to which a person or animal is exposed, proximate or positionally oriented, or close in proximity.

The Shield Guard 10 is provided with the shield body member 20. The member 20 is provided with its inboard surface 22 and its outboard surface 24; and is provided with a widthwise perimeter side 26 which extends completely around, or about, both surfaces 22 and 24, and provides the connection, width and thickness, perimeter and side wall dimension of/and between the surfaces 22 and 24; as illustrated in FIGS. 1A, 5 through 8, and 9A.

The widthwise perimeter side 26 has the first end section 28, the second end section 30, the first lateral portion 32 and the second lateral portion 34.

Figure 9:
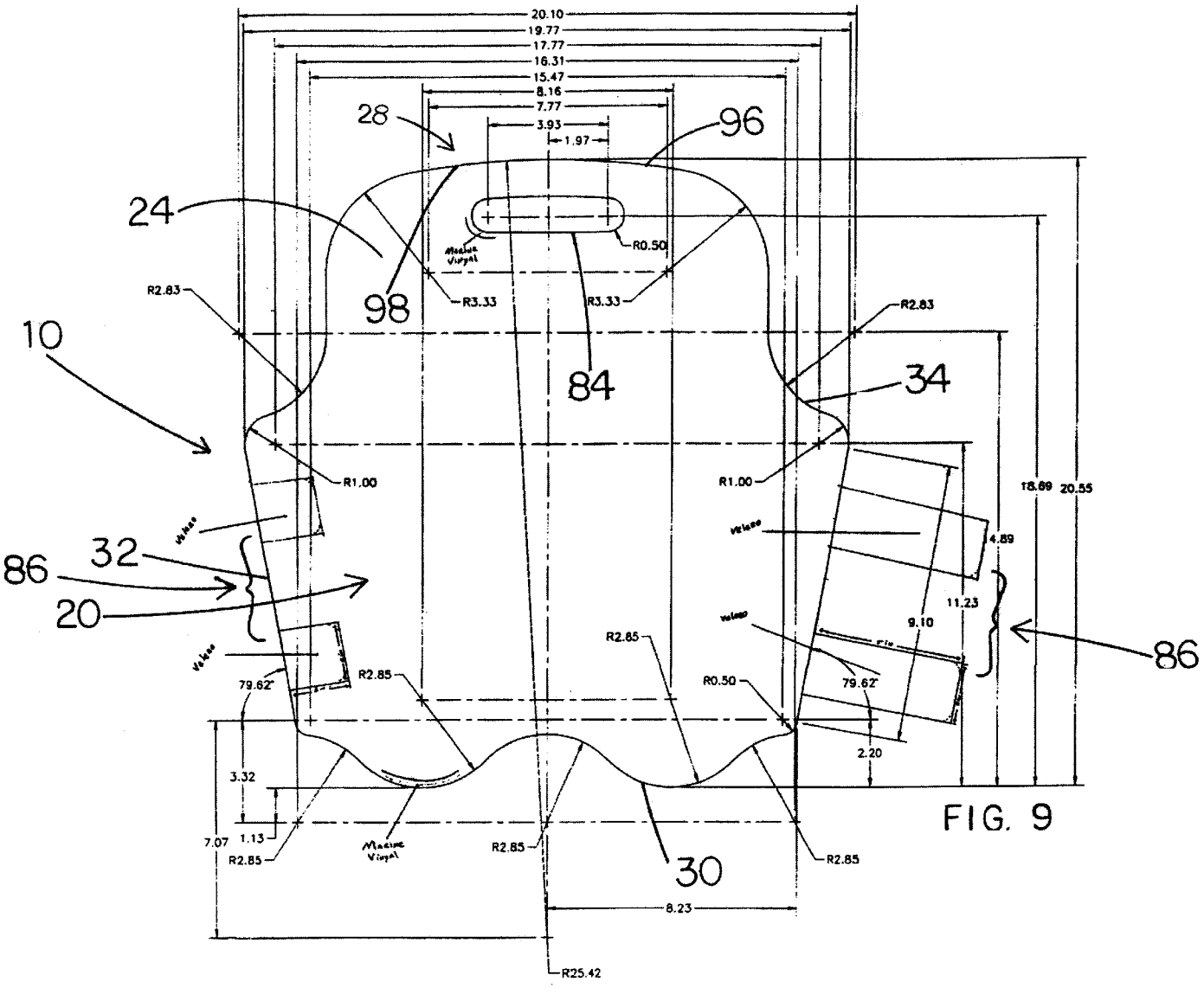
FIG. 9 is another embodiment of the invention, shown in elevated view from above the front or outboard surface; illustrating, for exemplar purposes only, dimensional data for one of a number of preferred embodiments within the scope of the present invention.
Figure 9A:
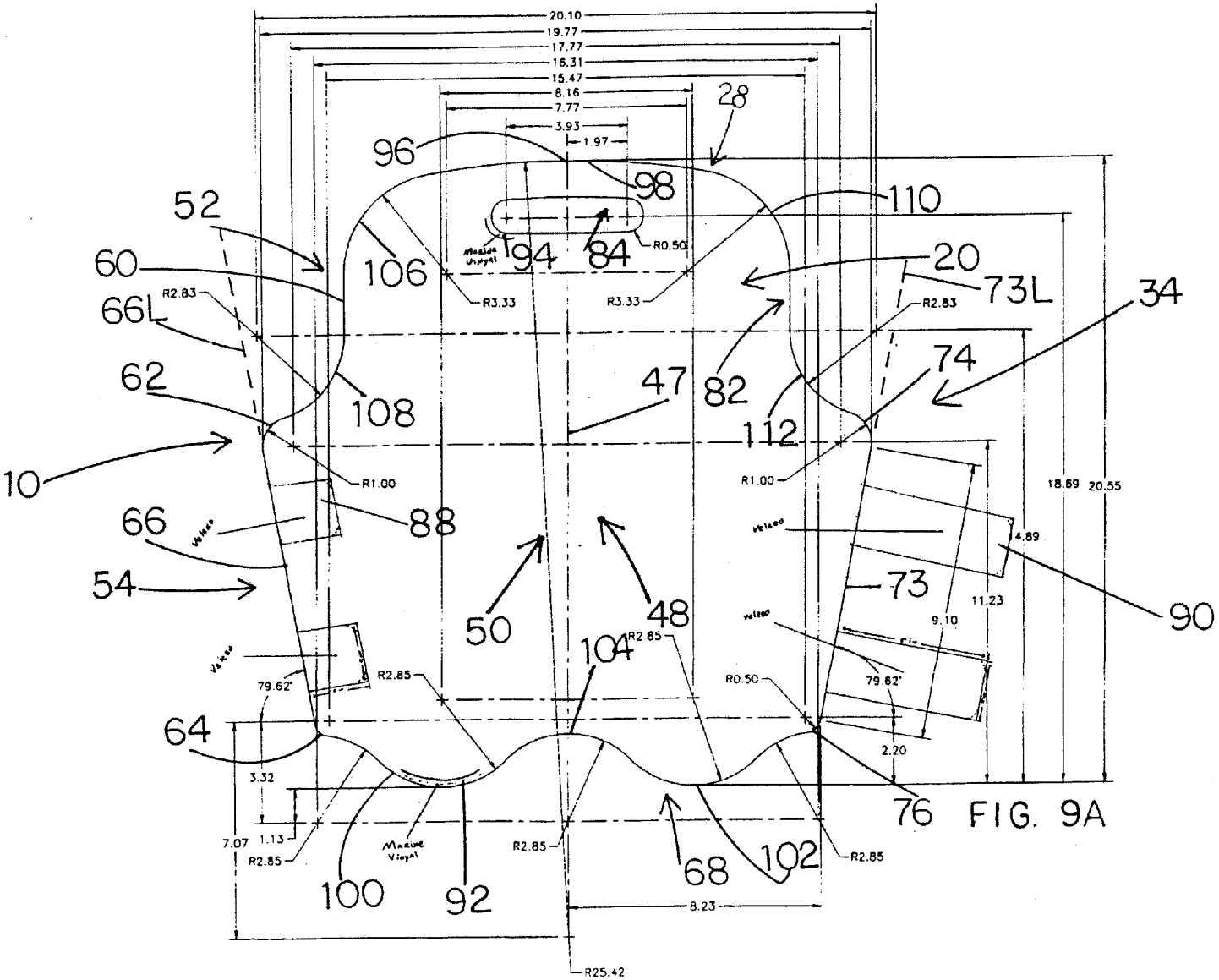
FIG. 9A is the same view as FIG. 9, set forth to show additional features or elements of preferred embodiments of the present invention.

The first end section 28 has first and second end portions 36 and 38, respectively, and a midpoint portion 40 extending between the end portions 36 and 38. The second end section 30 has first and second end portions 42 and 44, respectively, and a midpoint portion 46, extending therebetween. Each of the midpoint portions 40 and 46 has and defines between each other at least one (1) imaginary axis line 47, which generally or substantially bifurcates (or splits into portions) the inboard and outboard surfaces, as illustrated in FIGS. 1A and 9A; being split into the first and second bifurcated portions 48 and 50, respectively.

The first lateral portion 32, in preferred embodiments of the invention, is provided with first and further subportion segments 52 and 54. The first subportion segment 52 has first and second ends 56 and 58, respectively; and is provided substantially in the configuration of a sinusoidal wave portion 60, when viewed from above or below the Shield Guard 10, i.e., in relation to its outboard surface 24 or its inboard surface 22, respectively. As illustrated, the first end 56 is attached and connected (i.e., integrally or in section) to the second end portion 38 of the first end section 28.

It will be understood by those skilled in the art that a sinusoidal wave portion is, in part or in whole, an undulatory or wavelike configuration in general and generic terms; including, but not limited to, the graphic representation set forth by the sine curve formula: $y=\sin x$, in relation to a Cartesian coordinates and/or in relation to a t-axis line; and can include one or more peak and valley (or sulcate) areas.

The further subportion segment 54 of the first lateral section 32 has first and further rounded end portions 62 and 64 at either end of, what constitutes in preferred embodiments of the invention, the linear configurational portion 66, when viewed from above or below (as defined herein). The first rounded end portion 62 is attached or connected to the second end 58 of the first subportion segment 52; and the further rounded end portion 64 is attached or connected to the second end portion 44 of the second end section 30.

The second end section 30 is provided in the configuration of a sinusoidal wave 68, when viewed from above or below, as illustrated.

The second lateral portion 34 has, in one group of preferred embodiments of the present invention, first and further subportion segments 70 and 72, respectively. The further subportion segment 72 is provided with its linear configurational portion 73 and first and further rounded end portions 74 and 76, respectively, at either end thereof; when viewed from above or below and as illustrated in FIGS. 1A and 9A. The second rounded end portion 76 is attached or connected to the first end portion 42 of the second end section 30.

The first subportion segment 70 of the second lateral portion 34 is provided with first and second ends 78 and 80, respectively; and is provided in the configuration of a sinusoidal wave portion 82, between the ends 78 and 80, as viewed from above or below the Shield Guard 10. The second end 80 is attached to the first rounded end portion 74 of the further subportion segment 72, of the second lateral portion 34. The first end 78 is attached to the first end portion 36 of the first end section 28.

Figure 4:
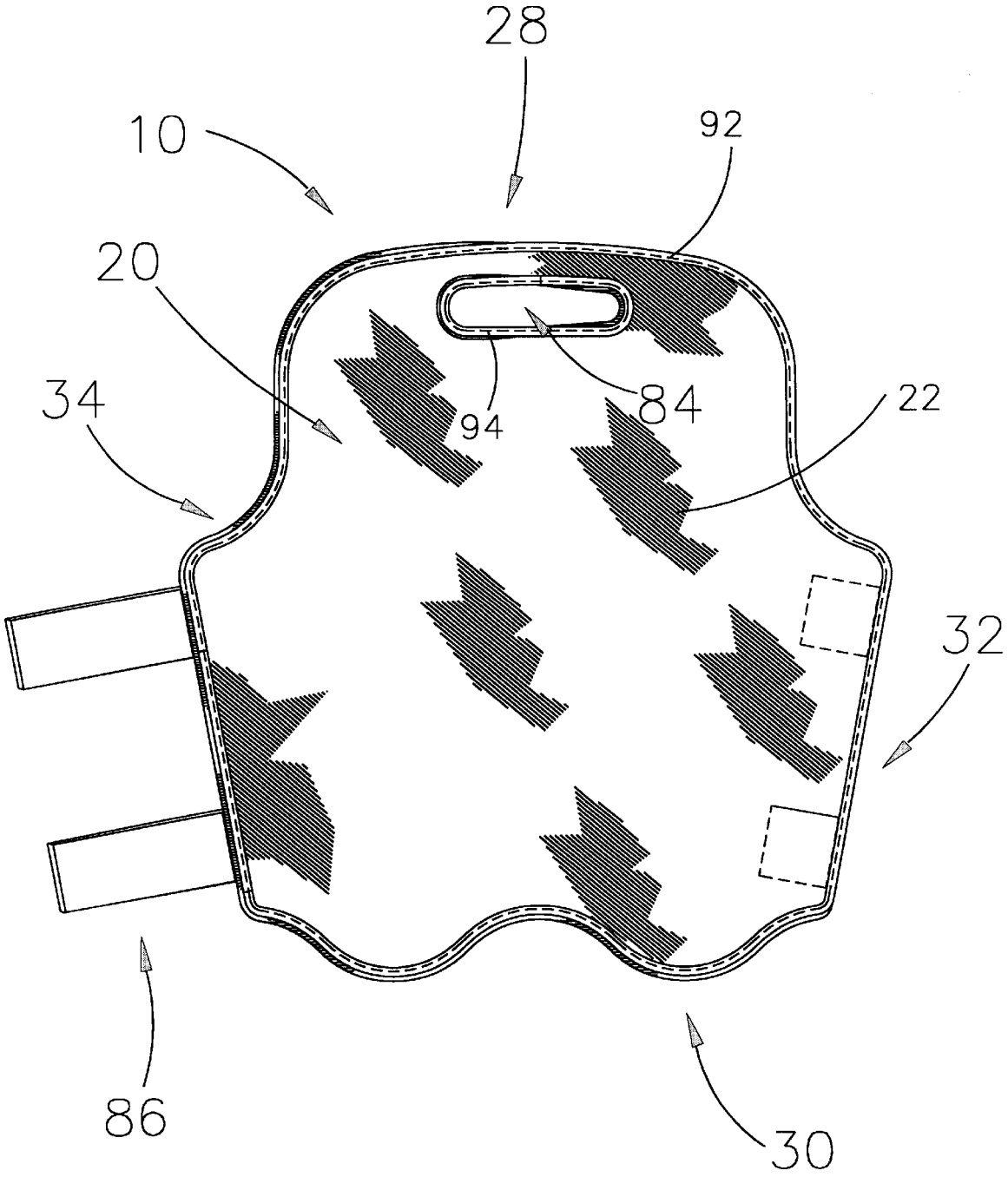
FIG. 4 is an elevated view from below the back or inboard surface of the present invention of FIG. 1.
Figures 5, 6, 7, 8:
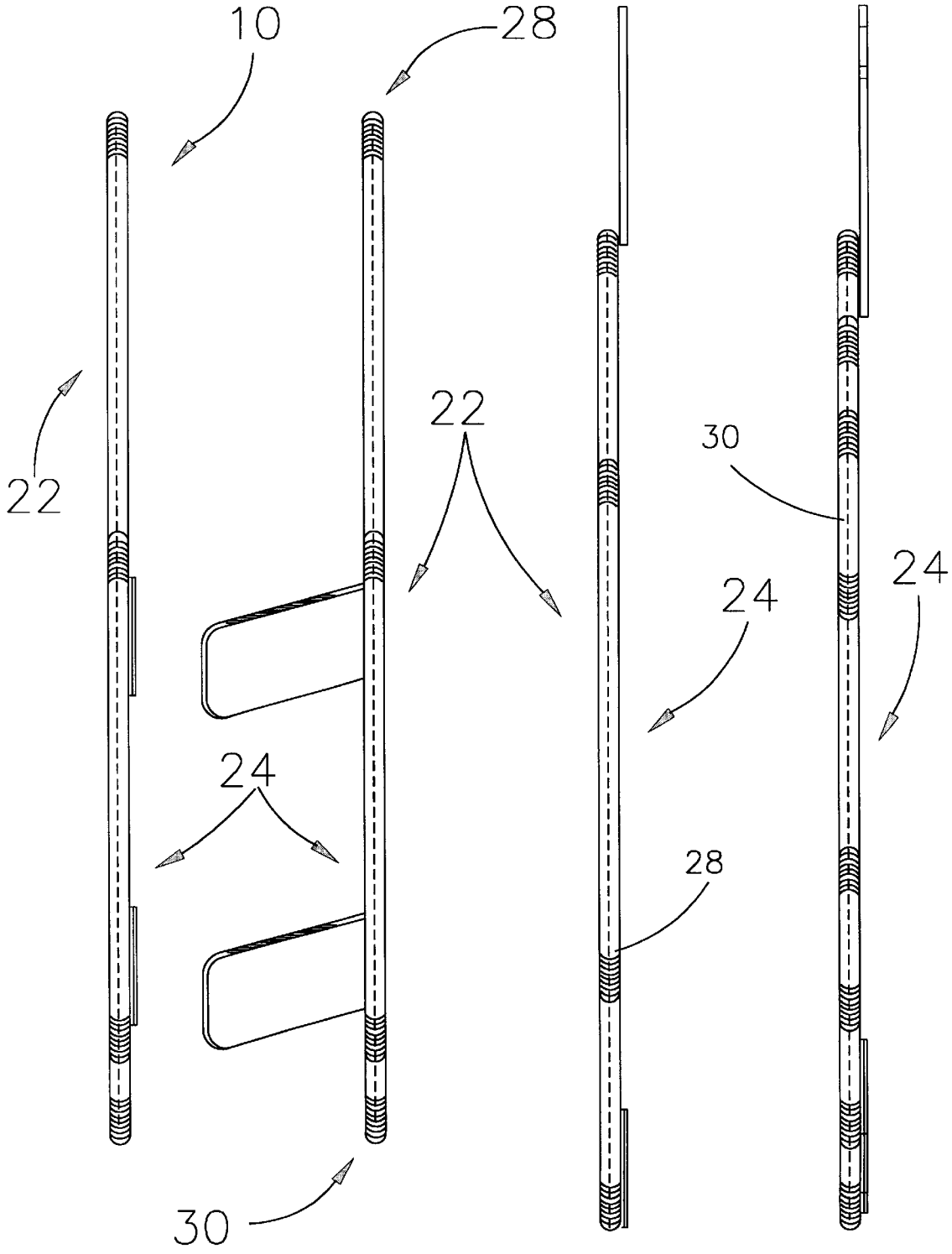
FIG. 5 is a left side view, in enlarged scale, of the invention of FIG. 1.
FIG. 6 is a right side view, in enlarged scale, of the invention of FIG. 1.
FIG. 7 is an elevated top view, in enlarged scale, of the invention of FIG. 1.
FIG. 8 is an elevated bottom view of the invention of FIG. 1.

The Shield Guard 10 is also, in preferred embodiments of the present invention, provided with the hand positioning hole 84. Preferably, the positioning hole 84 is made to extend completely through the inboard and outboard surfaces 22 and 24 (from one to the other) of the shield body member 20; although a depth of lesser dimensional width or magnitude can be utilized, to extend within one or both surfaces 22 and 24. The hole 84 is positionally placed in the center portion of the shield body 20, in positional proximity or orientation to the imaginary axis line 47, and in proximity to the first end section 28; as illustrated in FIGS. 1A, 4 and 9. However, it will be recognized, within the scope of the invention that the hole 84 can be placed at other areas of the shield body 20, extending through the surfaces 22 and 24, in part or in whole; to facilitate installation, positioning, and fitting of the Shield Guard 10 in relation to the limb of a user.

A coupling system 86 is also provided for securing and attaching, for installation purposes, the first lateral portion 32 to the second lateral portion 34, of the widthwise perimeter side 26 of the shield body 20 (or other adjacent portions), when it the body 20 is draped or made to go around or about a portion of the leg 12, or animal limb, for such purposes. As set forth later herein in greater detail, the coupling system 86 can take the form of hook and loop straps or bands (such as a VELCR0® system) and other means of systems of attachment and coupling for adjustable and securable installation of the Shield Guard 10, around, about or in relation to a preselected or selected portion of each leg 12 or limb.

Figure 2:
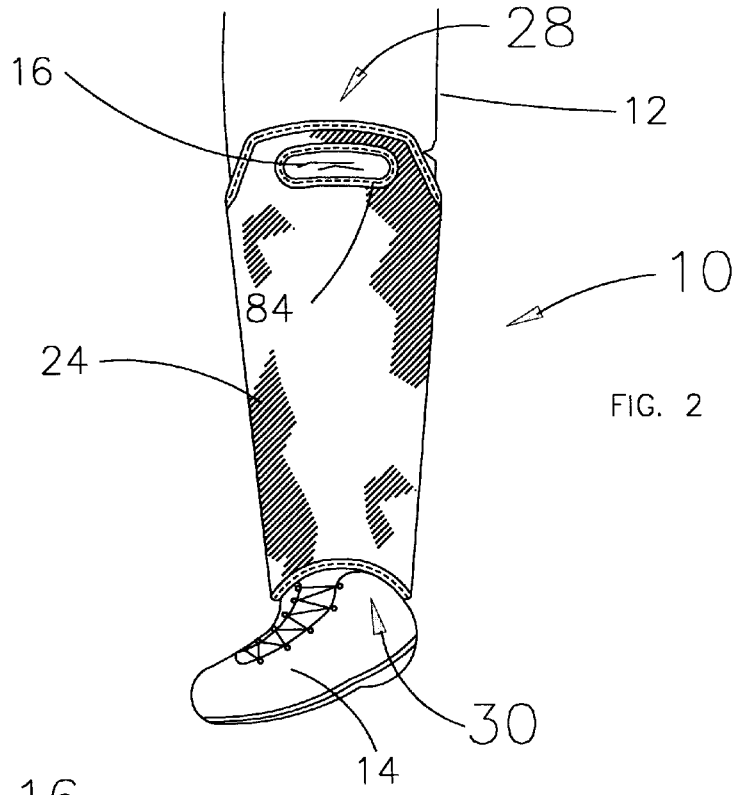
FIG. 2 is a front perspective view of a preferred embodiment of the present invention, illustrating one of a number of preferred installation fittings or positions of the invention in interaction with a user's leg shown in general, exemplar, diagrammatic representation.
Figure 3:
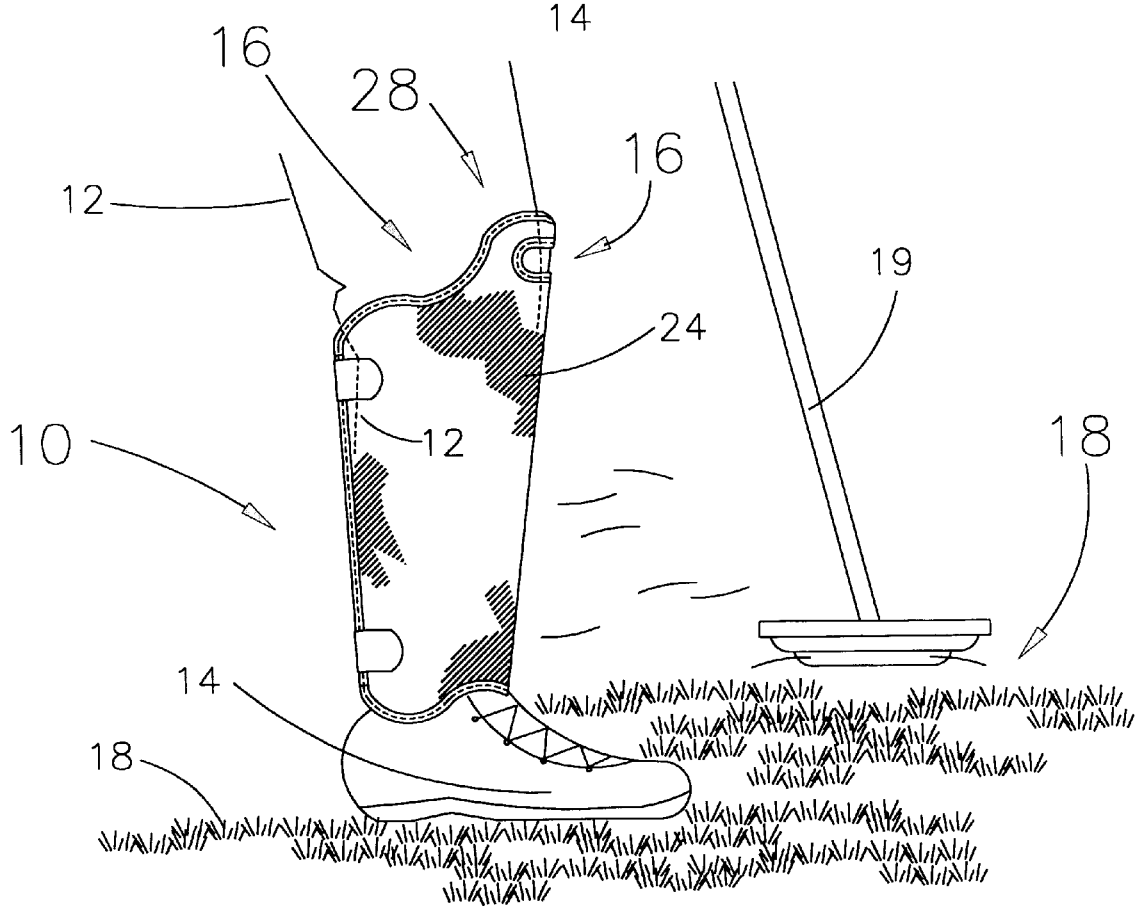
FIG. 3 is a side perspective view of the embodiment, of the invention, of FIG. 2; illustrating a user's leg, a grass or garden area and a weed-cutting, gardening device in general exemplar diagrammatic representation, as examples of an environment in interaction with which the invention can be utilized, and broken lines to show part of a user's leg, positionally, below the installed invention.

Therefore, as described thus far with regard to the preferred embodiments of the Shield Guard 10 of the present invention, the Shield Guard 10 is installable in interaction with the leg 12 (either leg), or limb, of a user; and can be adjustably fitted and positioned to shield and protect the lower areas and joints of a user's leg 12, and the middle leg portions of a user's leg 12 at and above the knee 16 (stifle) of such a leg 12 of a user; as illustrated by example in FIGS. 2 and 3.

In other preferred embodiments of the Shield Guard 10 the first and second bifurcated portions, 48 and 50, respectively; are mirror images of one another, when viewed from the outboard surface 24 (i.e., above) or the inboard surface 22 (i.e., below).

Also, in preferred embodiments, the coupling system 86 is provided with the hook band 88 and the loop band 90, as illustrated in FIGS. 1, 4, 5 through 8, and 9. It will be understood, within the scope and spirit of the present invention, that many other diverse types of elements can be utilized as part of the coupling system 86, such as flexible (or biasable) integral means connecting the first and second lateral portions 32 and 34, respectively (or other opposing adjacent areas); belting and/or clip means or banding means, or other tie or biasing, coupling systems; and that such coupling means and systems can be attached to the shield body 20 at various locations in various ways, to achieve the adjustable and securing function of the invention.

Figure 1A:
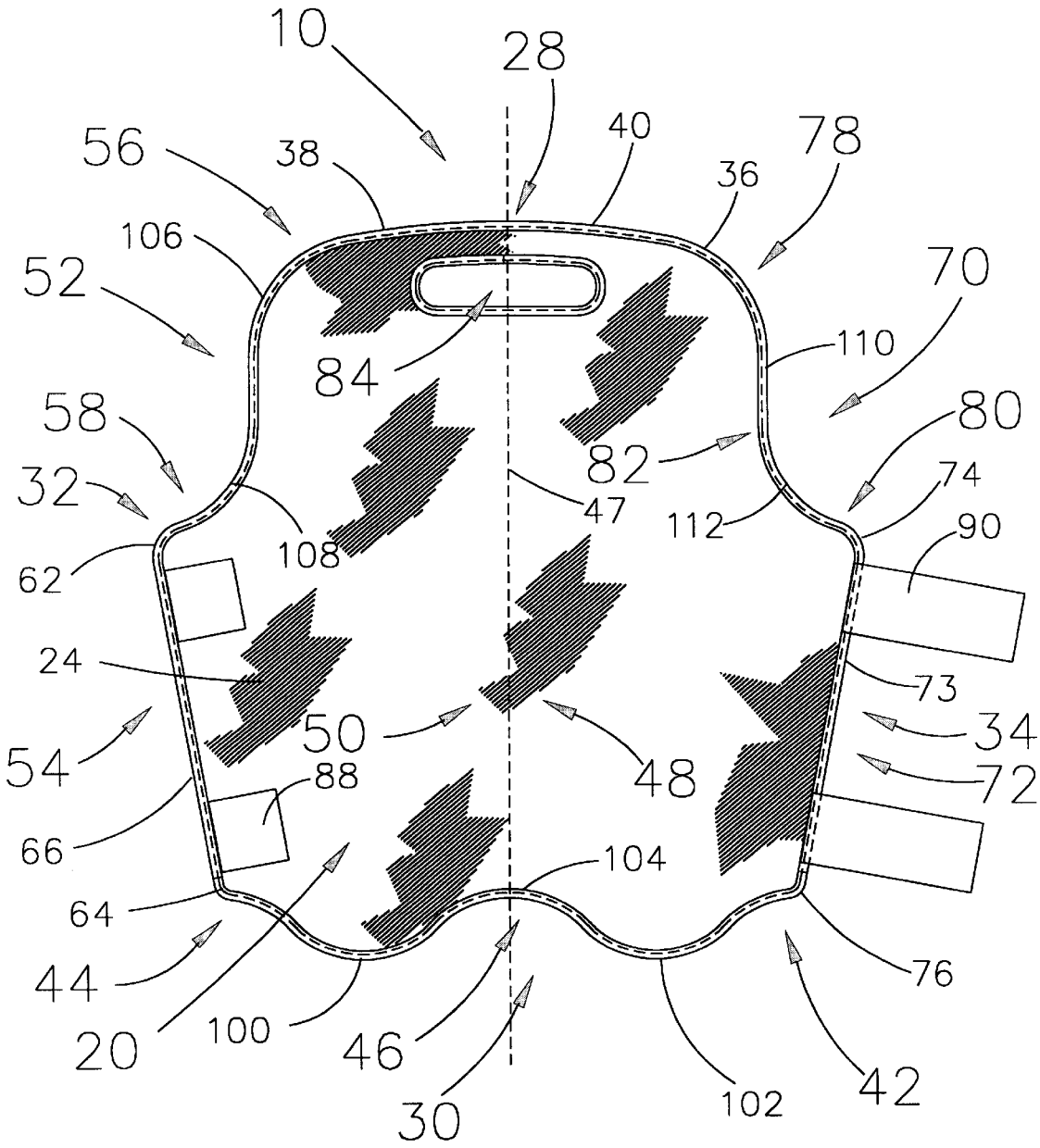
FIG. 1A is the same view as FIG. 1, set forth to show additional features and elements of the present invention.

In this regard, in preferred embodiments, the loop band 90 is positioned and attached along the outboard surface 24, adjacent or close to the further subportion segment 72 of the second lateral portion 34, as illustrated in FIGS. 1 and 9. And the hook band 88 is positioned and attached along the outboard portion 24, adjacent or close to the further subportion segment 54 of the first lateral portion 32. As illustrated, a spaced pair, respectively, of such hook band 88 and loop band 90 (two of each one together in opposing positional relation to one another) is provided; although it will be understood within the scope of the invention that one or more bands 88 and 90 can be provided along respective segments 54 and 72, or other adjacent, opposing locations.

Additionally, in preferred embodiments, the Shield Guard 10 is provided with first and further trim support trim support segments 92 and 94, respectively; as illustrated in FIGS. 1, 1A, 9, and other drawings. In preferred embodiments, the first trim support segment 92 is attached or connected to portions of the inboard and outboard surfaces 22 and 24 adjacent or close to elements of the widthwise perimeter side 26 previously described. And the further trim support segment 94 is attached or connected to perimeter portions of the hand positioning hole 84, and/or adjacent portions about or around the hole 84.

It will be understood, within the scope and spirit of the invention, that the trim support segments 92 and 94 can be of many diverse dimensions and thicknesses; can be attached or connected, as described and illustrated; in many ways, including, but not limited to, cementing and/or stitching means; and can be constructed or fabricated from a number of dynamically elastic and protective materials, including, but not limited to, marine vinyl, fabric, plastic or polymer and/or laminate or alloy materials. It will also be understood, within the scope of the invention, that the shield body 20, itself, can be fabricated from a diverse number of flexible, stain and impact resistant and protective constructive materials including, but not limited to, resilient polymer, glass, rubber, composite and/or alloy materials. In this regard, the shield body is preferably provided with a substantially see-through or transparent constructive material, having a width or thickness of from about 0.02 inches to about 0.06 inches, to augment a flexible protective guard and a visual monitoring by a user of the exact installment position or fitting of the shield body 20, or portions thereof, in relation to underlying clothing or equipment apparel and/or anatomical portions of a leg or limb of a user.

In preferred embodiments, the first end section 28 of the widthwise perimeter side 26 is provided in an arcuate (arced or curved) configuration, when viewed from the outboard surface 24 (above, as illustrated in FIGS. 1, 1A, 9 and 9A) or the inboard surface 22 (below, as illustrated in FIG. 4). In the examples illustrated in FIGS. 9 and 9A the first end 28 is provided with an arced convex-like perimeter 96, as so viewed (above and below).

Also, in preferred embodiments, the second end section 30 is provided in a wave-like form, having the first peak configurational subportion 100, the further peak configurational subportion 102, and the sulcate configurational subportion 104 (the valley shaped portion area between subportions 100 and 102); as illustrated in FIGS. 1A and 9A.

Also, in related, preferred embodiments the first subportion segment 52 of the first lateral portion 32 is provided with the peak configurational element 106 and the depressed sulcate configurational element 108; as illustrated in FIGS. 1A and 9A.

The term, "sulcate", as it is utilized herein, is an adjective, based on the 'noun', "sulcus"; which indicates or defines a meaning of groove-like, trench-like, furrow-like, depression-like or valley like, in relation to other adjacent or proximate positioned elements or shapes, as viewed.

In related, preferred embodiments, the linear configurational portion 66 of the further subportion segment 54 of the first lateral portion 32; extends from the further rounded end portion 64 to the first rounded end portion 62, so extending on a linear positional space/line 66L which is elevated or angled away and outboard of the imaginary axis line 47; as illustrated by example in FIGS. 1A and 9A.

In like manner (or mirror-imaged-like manner), the linear configurational portion 73 of the further subportion segment 72 of the second lateral portion 34; extends from the further rounded end portion 76 to the first rounded end portion 74, so that it substantially follows aline 73L, spatially elevated and angled away from, and outboard of, the imaginary axis line 47.

Also, in related preferred embodiments, the sinusoidal wave portion 82 of the first subportion segment 70 of the second lateral portion 34; is provided in a form further having or comprising the peak configurational element 110 and the depressed sulcate configurational element 112; as illustrated in FIGS. 1A and 9A, and other drawings.

The first trim support segment 92 can be attached by virtue of many diverse attachment or securement means or systems; and, in preferred embodiments, can be attached in many positional alignments so as to protectively cover the widthwise perimeter side 26; and to aid in protecting the user from any sharp edges that might exist from the fabrication of the shield body 20; although it will be understood that there are many ways to fabricate the shield body 20 so that its edges are smooth and user-friendly. Also, various types of stitching or other attachment or securement means used to secure the trim 92, can also be utilized within the scope of the invention to secure and attach elements or portions of the coupling system 86, or hook band 88 and/or loop band 90 (in such embodiments); or to reinforce such elements of the invention.

Figure 9B:
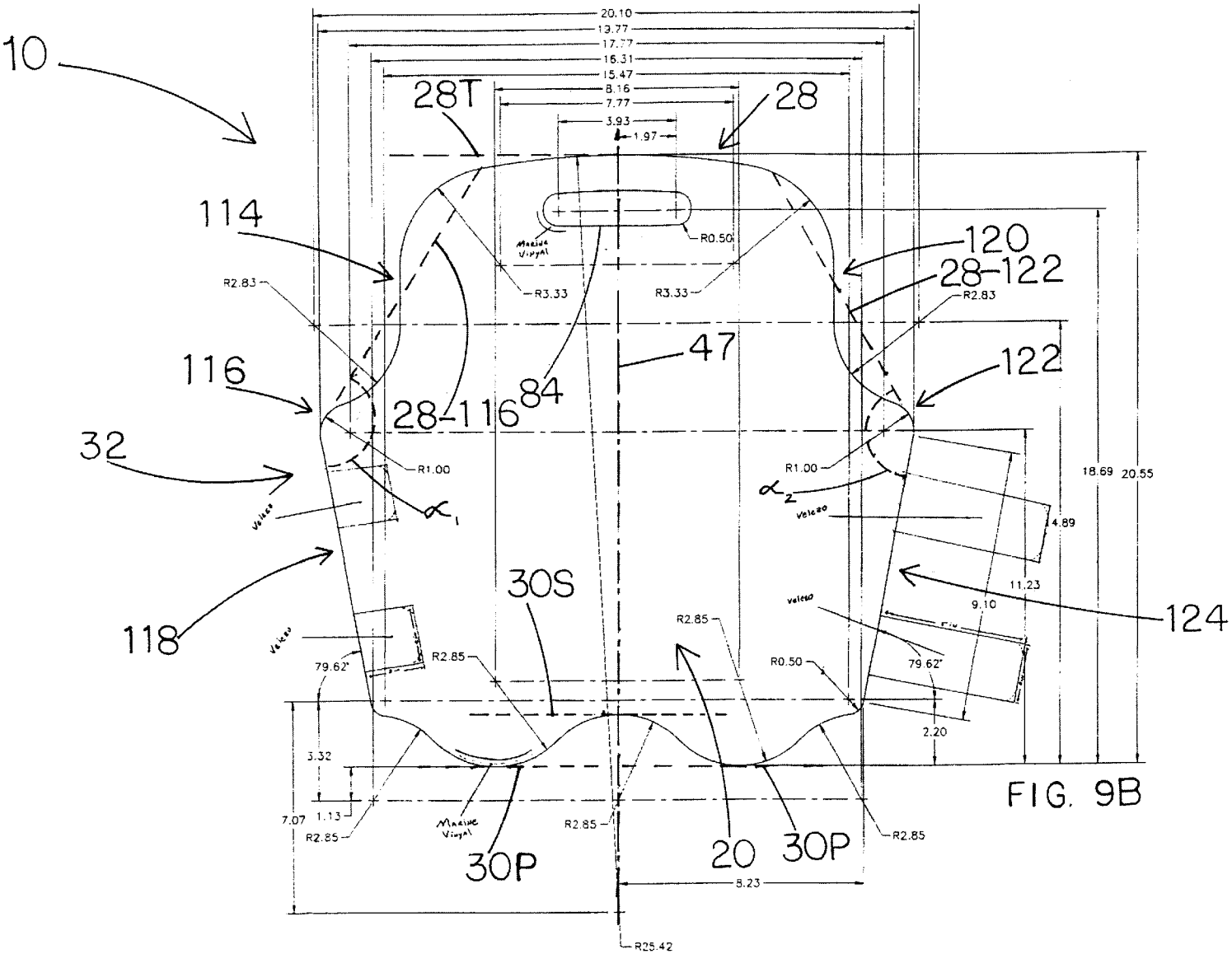
FIG. 9B is the same view as FIG. 9, set forth to show additional features or elements of preferred embodiments of the invention.

In addition, preferred embodiments of the present invention include, within the spirit thereof, the teaching whereby the first lateral portion 32 is conceptually divided into first, second and third subportions 114, 116, and 118, respectively; and the second lateral portion 34 is divided into first, second and third subportions 120, 122, and 124, respectively; as shown generally, by example, in FIG. 9B. Each of the second subportions 116 and 122 is, respectively, provided as an arced or rounded portion having first and second ends. Each of the subportions 116 and 122 is connected to an adjacent positioned end of the first end section 28 by respective, imaginary, t-line axes 28-116 and 28-122 (or t-lines), as illustrated in FIG. 9B. Additionally, the linear, or straight-lined portion of each of the third subportions 124 and 118, is positionally oriented in substantial relation to each respective t-line 28-122 and 28-116; so that respective imaginary obtuse angle alpha $alpha_1$ ($\alpha_1$) and $alpha_2$ ($\alpha_2$) (each angle>[greater than] 90° and <[less than]0 180°) are, each positionally created or generated, as set forth by example in FIG. 9B. Also imaginary tangent lines are defined, as illustrated, in relation to the first end section 28:

tangent line 28T; and in relation to the second end section 30: tangent lines 30P (in relation to peak curve areas) and 30S (in relation to sulcate-valley curve areas).

Various preferred, suggested dimensional data is elucidated in FIGS. 9, 9A and 9B, for purposes of suggested examples only; and not by way of general limitation or exclusivity with respect to the scope of the invention, which may be constructed in many diverse dimensions and dimensional embodiments, and angles, arcs, rounded areas and curves; in relation to positional lines, t-lines and/or tangent lines, or other geometric or mathematical reference points, lines or two and three dimensional spaces; each within the invention's scope and spirit. Certain embodiments of the present invention can be constructed in ranges of dimensioning, angles, arc and radial lengths and/or spacing, which encompass the suggested dimensioning data of FIGS. 9, 9A and 9B; and can be, so, provided in successfully functional embodiments of the present invention.

It will also be understood within the scope and spirit of the present invention that the opposing lateral portions 32 and 24, described herein, are provided in generally curvilinear configurational orientation, and more specifically in periodically curvilinear and sinusoidal curvilinear embodiments; and that in such embodiments, when viewed from above or below (the shield body 20), these lateral portions 32 and 34 are separated by opposing first and second end sections 28 and 30, where the first end section 28 is arced, curved or rounded; and the second end section 30 is in the configurational orientation, itself, of a periodic curve or a sinusoidal curve, with one or more maximum peak and minimum sulcate sub-curve area portions.

Additionally, elements of the coupling system 86, or hook band 88, or loop band 90 (in such embodiments), can be placed, within the scope of the invention, at various opposing locations on and about the shield body member 20.

Accordingly, the appended claims are intended to cover all changes, modifications and alternative options and embodiments falling within the true breath, scope and spirit of the present invention. The reader is, therefore, requested to determine the scope of the invention by the appended claims and their legal equivalents, and not by the examples which have been given.

What is claimed is:

1. A deflecting and protective shield guard, of flexible and resilient construction for use in interaction with either leg of a user, at middle, lower and adjacent portions thereof, in work areas where ground and airborne particles and substances are emitted in relation to work environment and work equipment to which a user is proximate and positionally oriented, or exposed to, said deflecting and protective guard comprising:

a shield body member, having inboard and outboard surfaces and a widthwise perimeter side extending thereabout, the widthwise perimeter side comprising first and second end sections and first and second lateral portions, each of the first and second end sections having first and second end portions and a midpoint portion therebetween, each of the midpoint portions of the respective first and second end sections defining, therebetween, an imaginary axis line which substantially bifurcates each of the inboard and outboard surfaces, when viewed from above and below, thereby defining a first bifurcated portion and a second bifurcated portion, each of the first and second lateral portions having first and second subportion segments, the first subportion segment of the first lateral portion having first and second ends and being substantially in the configuration of a sinusoidal wave portion between said first and second ends, when viewed from above and below, the first end, thereof, being attached to the second end portion of the first end section, the second subportion segment of the first lateral portion having first and second rounded end portions, and a linear configurational portion therebetween, when viewed from above and below, the first rounded end portion, thereof, being attached to the second end of the first subportion segment of the first lateral portion, and the second rounded end portion, thereof, being attached to the second end portion of the second end section, the second end section being in the configuration of a sinusoidal wave, when viewed from above and below, the second subportion segment of the second lateral portion having first and second rounded end portions, and a linear configurational portion therebetween, when viewed from above and below, the second rounded end portion, thereof, being attached to the first end portion of the second end section, the first subportion segment of the second lateral portion having first and second ends, and being substantially in the configuration of a sinusoidal wave, between said first and second ends, when viewed from above and below, the second end, thereof, being attached to the first rounded end portion of the second subportion segment of said second lateral portion, and the first end, thereof, being attached to the first end portion of said first end section;

means for transporting and installably positioning the shield body member, being defined by the inboard and outboard surfaces, thereof; and means for coupling the first lateral portion of the widthwise perimeter side to the second lateral portion of the widthwise perimeter side;

whereby, the deflecting and protective guard is installable in interaction with a leg of a user, and fitably positionable to shield and protect the lower areas and joints of a user's leg and the middle leg portions of a user's leg at and above the knee and stifle of such a leg of a user.

2. The deflecting and protective shield guard of claim 1, wherein:

the respective configurations of the first and second bifurcated portions are mirror-images of one another, when viewed from above and below.

3. The deflecting and protective shield guard of claim 1, wherein:

said means for transporting and positioning the shield body is defined as a channel hole extending throughout said inboard and outboard surfaces and being positioned proximate to the first end section of the widthwise perimeter side.

4. The deflecting and protective shield guard of claim 1, wherein:

the means for coupling comprises an adjustable hook and loop subassembly having first and second interacting portions, positioned to function, in relation to one another, adjacent to the respective second subportion segments of the first and second lateral portions of the widthwise perimeter side.

5. The deflecting and protective shield guard of claim 4, wherein:

the first interacting portion of the hook and loop subassembly is positioned and attached to the outboard surface of the shield body member adjacent to the first lateral portion, and the second interacting portion, thereof, is positioned and attached to the outboard surface of the shield body member, adjacent to the second lateral portion thereof.

6. The deflecting and protective shield guard of claim 1, wherein:

said deflecting and protective guard further comprises a trim support means, positioned and secured about and in contact with the widthwise perimeter side, the transporting and positioning means, and, at least a portion of the inboard surface and the outboard surface, of the shield body member.

7. The deflecting and protective shield guard of claim 6, wherein the trim support means is constructed and fabricated from a group of material consisting of marine vinyl, polymer, and resilient and protective fabric material.

8. The deflecting and protective shield guard of claim 1, wherein:

said shield body member is constructed and fabricated from a see-through and visually transparent material, chosen from a group of materials and substances consisting of resilient glass material, resilient polymer material, resilient and flexible alloy material and resilient and flexible composite material; and wherein said shield body member is fabricated to have a thickness of from about 0.02 inches to about 0.06 inches.

9. The deflecting and protective shield guard of claim 1, wherein:

the first end section of the widthwise perimeter side having an arcuate configuration, when viewed from above or below, said arcuate configuration having a convex perimeter shape, when so viewed.

10. The deflecting and protective shield guard of claim 9, wherein:

the second end section of the widthwise perimeter side having a first peak configurational subportion, a second peak configurational subportion, and a sulcate configurational subportion therebetween, when viewed from above and below the shield body member.

11. The deflecting and protective shield guard of claim 10, wherein:

the first subportion segment of the first lateral portion further comprises a peak configurational element and a depressed sulcate configurational element, when the shield body member is viewed from above and below thereof.

12. The deflecting and protective shield guard of claim 11, wherein:

the linear configurational portion of the second subportion segment, of the first lateral portion, extends from the second rounded end portion, thereof, to the first rounded end portion, such that it follows a line spatially elevated and angled away from, and outboard of, the imaginary axis line of the midpoint portions of the respective first and second end sections.

13. The deflecting and protective shield guard of claim 12, wherein:

the linear configurational portion of the second subportion segment, of the second lateral portion, extends from the second rounded end portion thereof, to the first rounded end portion, such that it follows a line spatially elevated and angled away from, and outboard of, the imaginary axis line of the midpoint portions of the respective first and second end sections.

14. The deflecting and protective shield guard of claim 13, wherein:

the first subportion segment of the second lateral portion further comprises a peak configurational element and a depressed sulcate configurational element.

15. The deflecting and protective shield guard of claim 14, wherein:

the peak configurational element of the first subportion segment, of the first lateral portion, is positionally oriented proximate to the second end portion of the first end section; and the depressed sulcate configurational element of the first subportion segment, of the first lateral portion, is positionally oriented proximate to the first rounded end of the second subportion segment of the first lateral portion.

16. The deflecting and protective shield guard of claim 15, wherein:

the peak configurational element of the first subportion segment, of the second lateral portion, is positionally oriented proximate to the first end portion of the first end section; and the depressed sulcate configurational element of the first subportion segment, of the second lateral portion, is positionally oriented proximate to the first rounded end of the second subportion segment of the second lateral portion.

17. The deflecting and protective shield guard of claim 9, wherein:

the convex perimeter shape of the arcuate configuration of said first end section is positionally oriented so as to face generally away from the second end section of said widthwise perimeter side.

18. The deflecting and protective shield guard of claim 10, wherein:

the sulcate configurational subportion is bifurcated by the imaginary axis line of the midpoint portions of the respective first and second end sections, when the shield body member is viewed from above and below thereof.

19. The deflecting and protecting device for use in interaction with joint, middle limb and lower limb areas of respective human and animal users, said deflecting and protecting device comprising:

a shield body having first and second end sections, first and second lateral portions, and inboard and outboard surfaces, the first end section having first and second arcuate ends and a middle portion, the middle portion defining an arcuate configuration, between the first and second arcuate ends, when viewed from the inboard and outboard surfaces of said shield body, the second end section having first and second arcuate end portions, and first, middle, and second portions therebetween the middle portion defining an arcuate configurational element having first and second ends; when viewed from the inboard and outboard surfaces; the first portion defining an arcuate wave subportion having first and second ends, when viewed from the inboard and outboard surfaces, the second end of the arcuate wave subportion of the first portion being connected to the first end of the arcuate configurational element of the middle portion and the first end thereof being connected to the first arcuate end portion of said second end section; the second portion defining a wave subportion having first and second ends, when viewed from the inboard and outboard surfaces, the first end of the wave subportion of the second portion being connected to the second end of the arcuate configurational element of the middle portion and the second end thereof being connected to the second arcuate end portion of said second end section, the first lateral portion having first, second and third subportions, the second subportion defining an arced portion having first and second ends, the first end thereof and the second arcuate end of the first end section defining therebetween an imaginary, t-line-axis, the first subportion defining a generally periodic function curve between the second arcuate end of the first end section and the first end of the arced portion of said second subportion, to which it is attached, when viewed from the inboard and outboard surfaces, the generally periodic function curve having a maximum positive peak point and a minimum negative point in positional relation to the t-line-axis, the third subportion defining a generally linear perimeter line between the second end of the arced portion of said second subportion and the second arcuate end portion of said second end section, to which it is attached, when viewed from the inboard and outboard surfaces; the generally linear perimeter line being positionally oriented at an obtuse angle in relation to the t-line-axis;

the inboard and outboard surfaces defining a handle positioning hole, extending therethrough; and means for coupling the first lateral portion to the second lateral portion, when placed in interaction with a user's limb, for protection thereof.

20. The deflecting and protecting device of claim 19, wherein:

the second lateral portion is, configurationally, a mirror-image of the first lateral portion;

the shield body is fabricated and constructed from a generally, visually transparent polymer material; and wherein said deflecting and protecting device further comprises a protective trim buffer assembly, being fixedly attached so as to cover the first and second end sections and the first and second lateral portions.

21. The deflecting and protecting device of claim 20, wherein:

the trim buffer assembly further covers areas of the handle positioning hole.

22. The deflecting and protecting device of claim 19, wherein:

the second lateral portion comprises first, second and third subportions, the second subportion, thereof, defining an arced portion having first and second ends, the first end thereof and the first arcuate end of the first end section defining, therebetween, an imaginary, t-axis, the first subportion defining a generally periodic functional curve between the first arcuate end of the first end section and the first end of the arced portion of said second subportion, to which it is attached, as viewed from the inboard and outboard surfaces of said shield body, said generally periodic function curve having a maximum positive peak point and a minimum negative point in positional relation to the t-axis, the third subportion defining a generally linear perimeter line between the second end of the arced portion of said second subportion and the first arcuate end portion of said second end section, to which it is attached, as viewed from the inboard and outboard surfaces; the generally linear perimeter line being positionally oriented at an obtuse angle in relation to the t-axis.

23. The deflecting and protecting device of claim 22, wherein:

the shield body is fabricated and constructed from a generally, transparent, flexible and resilient polymer material, such that a user can visually see through said shield body when it is installed in interaction with a user's limb, thereby visualizing the position of areas of such a limb adjacent to said shield body for monitoring of installation and fitting location thereof, or a user's assistant or companion can so visualize such positions and areas, and wherein:

the arcuate configuration of the middle portion of said first end section has a radial length of from about 20 inches to about 30 inches, and the first and second arcuate ends thereof, each, have a radial length of from about 2 inches to about 5 inches, the first and second arcuate end portions of said second end section, each, have a radial length of from about 0.10 inches to about 2.5 inches, the arcuate configurational element of the middle portion thereof has a radial length of from about 1.0 inches to about 4.0 inches, the arcuate wave subportion of the first portion thereof has a radial length of from about 1.0 inches to about 4.0 inches, and the wave subportion of the second portion thereof has a radial length of from about 1.0 inches to about 4.0 inches, the arced portion of the second subportion of said first lateral portion has a radial length of from about 0.25 inches to about 3.0 inches, the maximum positive peak point of the generally periodic function curve of the first subportion has a radial length of from about 1.0 inches to about 4.5 inches, the minimum negative point of said generally periodic function curve of the first subportion has a radial length of from about 0.8 inches to about 4.0 inches, and the generally linear perimeter line of the third subportion has a length of from about 5.0 inches to about 15.0 inches, and the arced portion of the second subportion of said second lateral portion has a radial length of from about 0.25 inches to about 3.0 inches, the maximum positive peak point of the generally periodic function curve of the first subportion thereof has a radial length of from about 1.0 inches to about 4.5 inches, the minimum negative point of said generally periodic function curve of the first subportion has a radial length of from about 0.8 inches to about 4.0 inches, and the generally linear perimeter line of the third subportion has a length of from about 5.0 inches to about 15.0 inches.

24. The deflecting and protecting device of claim 23, wherein:

the arcuate configuration of the middle portion of the first end section further defines an imaginary tangent line axis positioned at and adjacent to its radial length, the arcuate wave subportion of the first portion of the second end section further defines an imaginary, tangent line axis positioned at and adjacent to its radial length, and the wave subportion of the second portion of the second end section further defines an imaginary, tangent line axis positioned at and adjacent to its radial length, the dimensional distance between the tangent line axis of the arcuate configuration of the middle portion of the first widthwise end section and the tangent line axis of the arcuate wave subportion of the first portion of the second end section being from about 15.0 inches to about 26.0 inches, and the dimensional distance between the tangent line axis of the arcuate configuration of the middle portion of the first end section and the tangent line axis of the wave subportion of the second portion of the second end section being from about 15.0 inches to about 26.0 inches; wherein:

the dimensional distance between the second end of the arced portion of the second subportion of said first widthwise lateral portion and the second end of the arced portion of the second subportion of said second lateral portion being from about 15.5 inches to about 25.5 inches; and wherein:

the arcuate configurational element of the middle portion of the second end section further defines an imaginary, tangent line axis positioned at and adjacent to its radial length, the dimensional distance between the tangent line axis of the arcuate configuration of the middle portion of the first end section and the tangent line axis of the arcuate configurational element of the middle portion of the second end section being from about 11.0 inches to about 23.0 inches.

25. The deflecting and protecting device of claim 24, wherein:

the general dimensional distance between the first and second arcuate end portions of the second end section is from about 12.0 inches to about 18.0 inches, and the general dimensional distance between the first and second arcuate ends of the first end section is from about 7.5 inches to about 12.0 inches.

26. A deflecting and protective guard, of flexible and resilient construction, for use in interaction with a user's leg at middle, lower and adjacent portions thereof, in work areas where ground and airborne debris or particles are emitted in relation to a work site and a user so located, said deflecting and protective guard comprising:

a shield body having first and second end sections, first and second lateral portions, and inboard and outboard surfaces, and being fabricated and constructed of a generally transparent material and substance, chosen from a group of substances and materials consisting of see-through polymer substances, rubber substances, and polymer laminate materials;

the first end section having first and second arcuate ends, each having a center point, and a middle portion therebetween, the middle portion defining an arcuate configuration having a center point, as viewed from the inboard and outboard surfaces of said shield body, the arcuate configuration of the middle portion having a radial length at its center point of from about 24.4 inches to about 26.4 inches, and the first and second arcuate ends, each, having a radial length at their respective center points of from about 2.3 inches to about 4.3 inches, the arcuate configuration of said middle portion defining an imaginary tangent line axis positioned at, and adjacent to, the center point thereof, the second end section having first and second arcuate end portions and first, middle and second portions, therebetween, the middle portion defining an arcuate configurational element having first and second arcuate ends, and a center point, as viewed from the inboard and outboard surfaces, said center point thereof defining an imaginary axial line bifurcating the shield body, and, thereby, defining first and second bifurcated half portions, as viewed from the inboard and outboard surfaces, having a dimensional length of from about 18.5 inches to about 19.5 inches, the arcuate configurational element of said middle portion having a radial length at its center point of from about 1.8 inches to about 3.9 inches, the first portion of said second end section defining an arcuate wave subportion having first and second ends, and a center point, therebetween, as viewed from the inboard and outboard surfaces, the second end of the arcuate wave subportion of said first portion being connected to the first arcuate end of the arcuate configurational element of the middle portion, and the first end of the arcuate wave subportion of said first portion being connected to the first arcuate end portion of said second end section, the arcuate wave subportion having a radial length at its center point of from about 1.8 inches to about 3.9 inches, the first arcuate end of said second end section further comprising a center point, and having a radial length at its center point of from about 0.25 inches to about 1.0 inches;

the second lateral portion comprising first, second and third subportions, the second subportion, thereof, defining an arced portion having first and second ends, and a center point, the first end thereof and the first arcuate end of the first end section defining, therebetween, an imaginary t-axis line, said arced portion having a radial length at its center point of from about 0.5 inches to about 1.5 inches, the first subportion of said second lateral portion defining a generally periodic functional curve between the first arcuate end of the first end section and the first end of the arced portion of said second subportion, to which it is connected, as viewed from the inboard and outboard surfaces, the generally periodic functional curve having maximum positive peak point and a minimum negative point in positional relation to the t-axis line, the radial length at the maximum positive peak point being from about 2.3 inches to about 4.3 inches, the radial length at the minimum negative point being from about 1.8 inches to about 3.8 inches, the third subportion of said second lateral portion defining a generally linear perimeter line between the second end of the arced portion of said second subportion and the first arcuate end portion of said second end section, to which it is attached, as viewed from the inboard and outboard surfaces, the generally linear perimeter line being positionally oriented at an obtuse angle in relation to the t-axis line, the generally linear perimeter line having a dimensional lengthwise magnitude of from about 8.0 inches to about 10.1 inches, the second befurcated half portion encompassing the second lateral portion; the first arcuate end portion of the second end section, the first portion of the second end section, and substantially half of the arcuate configurational element of the middle portion of the second end section up to its center point, as viewed from the inboard and outboard surfaces; and further encompassing the first arcuate end of the first end section and substantially half of the arcuate configuration of the first end section up to its center point, the first bifurcated half portion encompassing the first lateral portion, the second arcuate end portion of the second end section, the second portion of the second end section, and substantially half of the arcuate configurational element of the middle portion of the second end section up to its center point, as viewed from the inboard and outboard surfaces; and further encompassing the second arcuate end of the first end section and substantially half of the arcuate configuration of the first end section up to its center point;

the first bifurcated half portion being a mirror image, configurationally, of the second bifurcated half portion, when viewed from the inboard and outboard surfaces;

handle and positioning means for transporting and fitting said deflecting and protective guard, being defined by the inboard and outboard surfaces as a handle positioning hole extending between said inboard and outboard surfaces, the handle positioning hole being positionally oriented proximate to the first end section of said shield body;

hook and loop means for coupling the second lateral portion of said shield body to the first lateral portion thereof, for securing said deflecting and protective guard, as fitted, to a user 's leg; and trim protective means attached to the shield body, so as to cover the first and second end sections and the first and second lateral portions, for buffer and protection thereof, said trim protective means being attached to the inboard and outboard surfaces, and dimensioned and fitted so as to define a perimeter on each of the inboard and outboard surfaces proximate and adjoining the configuration of the first and second end sections and the first and second lateral portions.

* * * * *